United States Patent [19]

Hardy

[11] Patent Number: 4,949,849

[45] Date of Patent: Aug. 21, 1990

[54] ADJUSTABLE GREETING CARD DISPLAY ASSEMBLY

[75] Inventor: Stephen N. Hardy, Copley, Ohio

[73] Assignee: American Greetings Corporation, Cleveland, Ohio

[21] Appl. No.: 308,660

[22] Filed: Feb. 9, 1989

[51] Int. Cl.[5] ..... A47F 7/00

[52] U.S. Cl. ..... 211/55; 211/128; 211/184

[58] Field of Search ..... 211/55, 128, 184; 40/124, 124.2, 124.4

[56] References Cited

U.S. PATENT DOCUMENTS

| | | | |
|---|---|---|---|
| 877,760 | 1/1908 | Copp et al. . | |
| 905,578 | 12/1908 | Read . | |
| 1,035,553 | 8/1912 | Doering, Sr. | 211/55 |
| 1,117,255 | 11/1914 | Schmidt . | |
| 1,254,766 | 1/1918 | Blades, Jr. . | |
| 1,595,437 | 8/1926 | Webster . | |
| 2,821,308 | 1/1958 | Burrows | 211/128 X |
| 2,872,185 | 2/1959 | Kropp | 40/124.2 X |
| 3,298,538 | 1/1967 | Ganz et al. . | |
| 3,304,142 | 2/1967 | Rockola | 211/184 X |
| 3,394,973 | 7/1968 | Scott . | |
| 3,667,826 | 6/1972 | Wood et al. . | |
| 4,077,520 | 3/1978 | Stevenson | 211/55 |
| 4,183,438 | 1/1980 | Huczek | 211/184 X |
| 4,244,129 | 1/1981 | Foerster et al. | 211/55 X |
| 4,328,631 | 5/1982 | Foerster | 211/55 X |
| 4,395,955 | 8/1983 | Pfeifer | 211/184 X |

*Primary Examiner*—Blair M. Johnson

*Attorney, Agent, or Firm*—Baldwin, Egan & Fetzer

[57] ABSTRACT

Adjustable greeting card display assembly. This assembly has a supporting structure and a display panel formed by a plurality of pocket forming central dividers and a pair of pocket forming end dividers. Each central divider includes a plurality of half pockets in step relationship, formed by a vertical sheet which forms a common side wall for the half pockets, and sheets extending laterally in both directions from the vertical sheet to form the fronts, backs and bottoms of the half pockets. The end dividers are like the central divider except that the sheets forming the fronts, backs and bottoms of the half pockets extend in only one direction from the vertical sheet. The supporting structure includes at least one transversely extending slotted support rail. Each of the dividers includes a transverse socket for the support rail, and a vertical web which engages a selected slot in the support rail. Each pair of adjacent dividers together form a series of whole pockets for cards. The dividers can be moved closer together or farther apart as desired, depending on the width of the cards to be displayed.

7 Claims, 4 Drawing Sheets

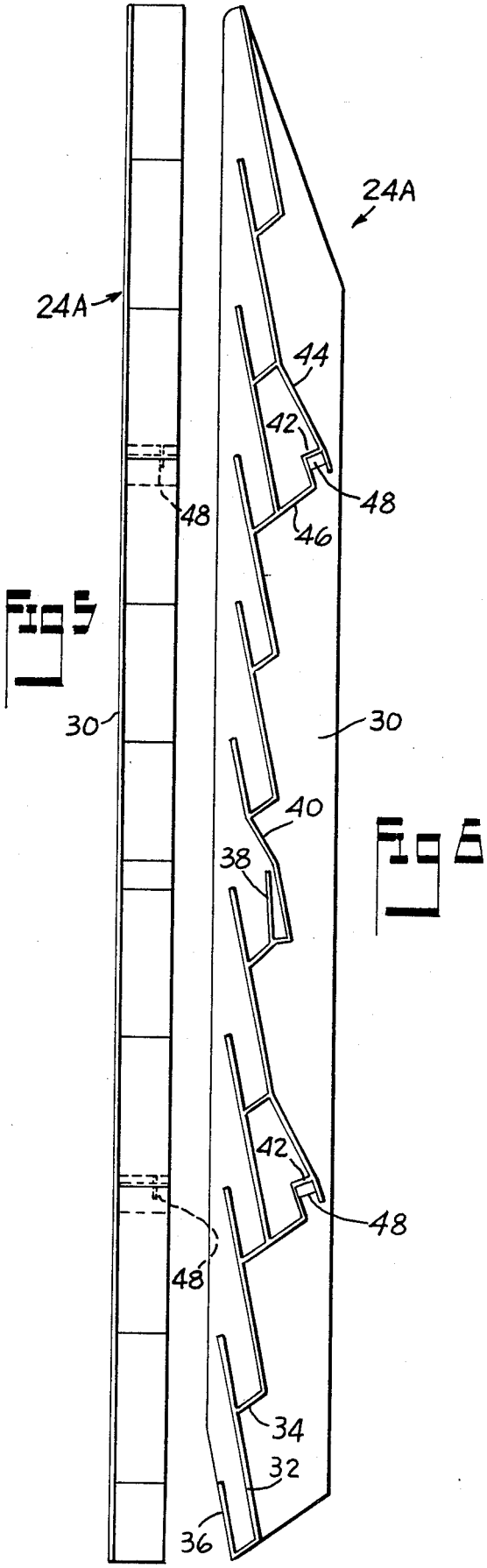
Fig 5
Fig 6
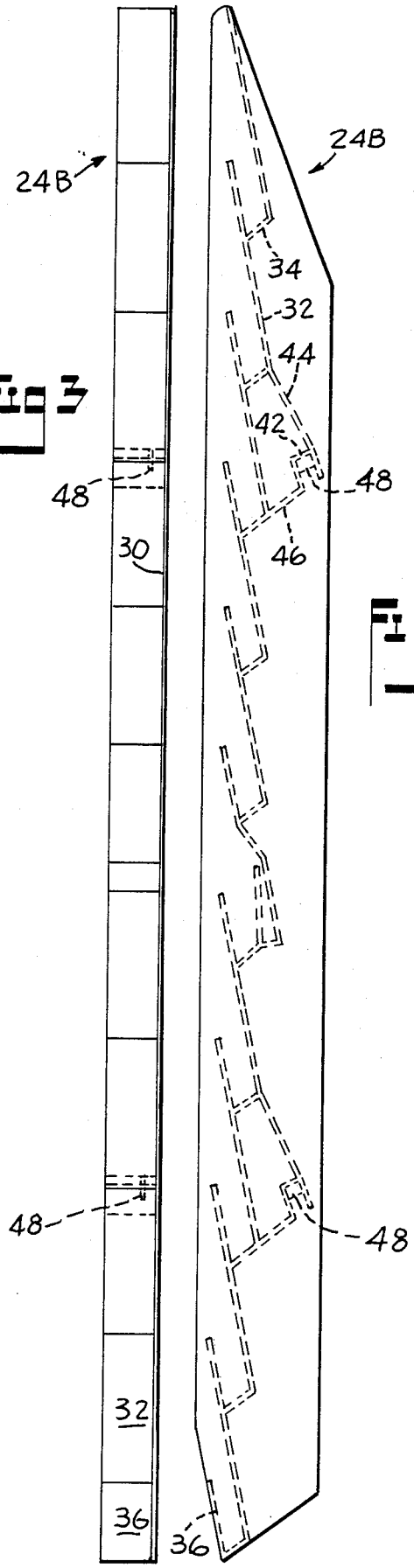
Fig 3
Fig 4

ADJUSTABLE GREETING CARD DISPLAY ASSEMBLY

TECHNICAL FIELD

This invention relates to display racks or assemblies for greeting cards, pamphlets and the like. More particularly, this invention relates to a portable and adjustable greeting card display assembly which is capable of displaying greeting cards of different widths and in which the dividers separating adjacent columns of greeting cards can be readily moved to suit the needs of the vendor.

BACKGROUND ART

Many, and perhaps most, greeting card displays are fixed, i.e., they are in the form of a built in counter requiring a substantial capital investment, and capable of disassembly or modification only as part of a remodeling of the store or other premises where they are located. Typically the cards are displayed in a plurality of rows arranged in stair step fashion, either with no partitions between adjacent cards in the same row, or with fixed partitions which are intended for only one width of greeting card.

Portable greeting card display racks are also known. These also typically have a plurality of pockets or compartments arranged in step relationship and extending horizontally from one side of the display rack to the other. These typically either have no vertical partitions at all or have vertical partition members which extend the entire height of the greeting card display. In the former case, greeting cards in the same row are easily pushed together in overlapping fashion. In the latter case, partitions are cumbersome to insert and remove to accommodate cards of different width, because of their appreciable length. The partitions are inserted and removed only with some difficulty, with care being required to assure that the partitions are absolutely vertical, which is necessary so that the distance between any two adjacent partitions will be uniform over the entire height of the card display.

SUMMARY OF THE INVENTION

The present invention provides an adjustable display assembly comprising:

a supporting structure, and a plurality of pocket forming members adjustably positioned on and supported by said supporting structure in side by side relationship, each of said pocket forming members including transversely extending members forming the front, back and bottom walls of a plurality of half pockets arranged in stepped relationship, and a vertical wall intersecting said transversely extending members and forming a common side wall for said half pockets, said vertical wall and said transversely extending members being integrally joined together, said half pockets being open along the side opposite said vertical wall, at least one of said pocket forming members being a divider in which said vertical wall is positioned between the side edges of said transversely extending members so as to form a plurality of half pockets on each side of said vertical wall, each of said pocket forming members, together with a pocket forming member laterally adjacent thereto, forming a plurality of pockets.

BRIEF DESCRIPTION OF THE DRAWINGS

In the drawings:

FIGS. 3 and 4 are a front elevation and a side elevation, respectively, of a right-hand pocket forming end divider according to this invention.

FIGS. 5 and 6 are a front elevation and a side elevation, respectively, of a left-hand pocket forming end divider according to this invention.

DESCRIPTION OF THE PREFERRED EMBODIMENTS AND ALTERNATE EMBODIMENT

This invention will now be described in detail with reference to the best mode and preferred embodiment thereof.

Figure 1:
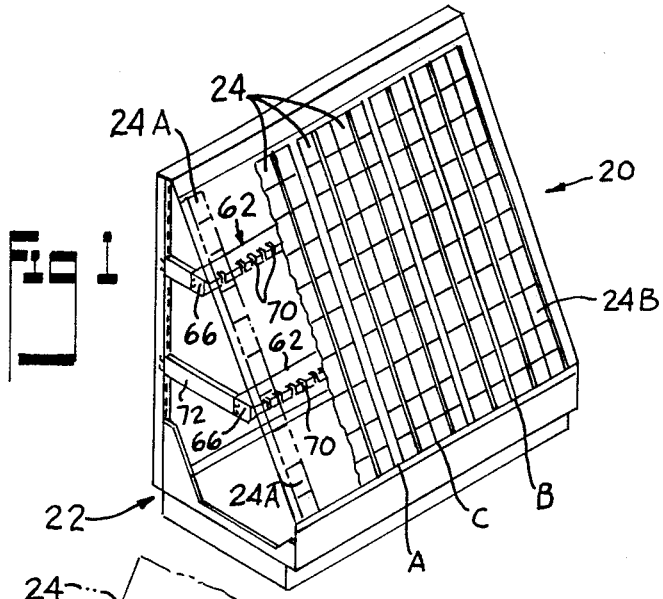
FIG. 1 is a perspective view of a display assembly according to a preferred embodiment of this invention.

Referring to FIG. 1, 20 is an adjustable display assembly or rack according to this invention. Display assembly 20 comprises a supporting structure 22 and a display panel for greeting cards, pamphlets or the like, comprising a plurality of central dividers 24, and left-hand and right-hand end dividers 24A and 24B, respectively, which are placed on the left and right sides, respectively, of the display panel.

All parts are preferably made of sheet steel unless otherwise stated although the dividers may be molded from a plastic material.

Figure 7:
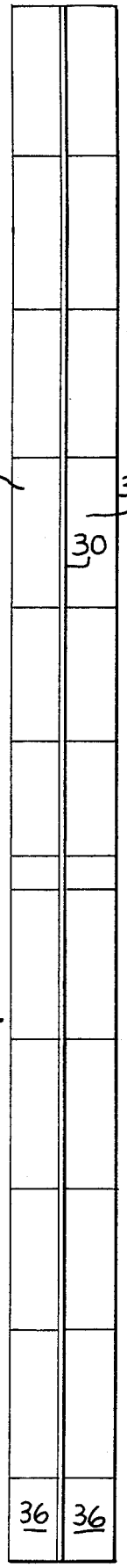
FIGS. 7 and 8 are a front elevation and side elevation, respectively, of a pocket forming central divider according to this invention.
Figure 8:
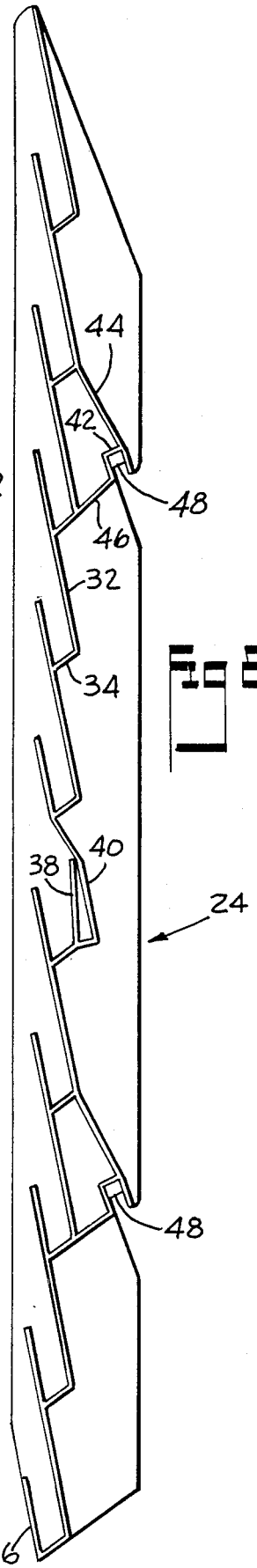

The central divider 24 will now be described in detail with reference to FIGS. 2, 7 and 8. A pocket forming divider 24 comprises a vertical wall 30, and a pocket forming structure extending laterally on both sides of the vertical wall 30. This pocket forming structure comprises plurality of steeply sloping (and optionally vertical) back members 32, a plurality of gently sloping (and optionally horizontal) bottom members 34, and a single steeply sloping front member 36, which extends upwardly from the front edge of the lowermost bottom member 34 and is parallel to the back members 32 but of lesser height. Back members 32, bottom members 34, front member 36, and vertical wall 30, together form a plurality of compartments or half pockets in stepped relationship for greeting cards or the like. Corresponding side edges of members 32, 34 and 36 on each side of vertical wall 30 are aligned so that they lie in a common plane. Each of the back members 32, except the highest, form the front for a half pocket as well as the back for the half pocket immediately below that. Vertical wall 30 forms a common side wall for all of the half pockets formed via divider 24. There are two series of half pockets, one on either side of vertical wall 30, each comprising a plurality of half pockets arranged in stair step fashion, one above and behind the other. The half pockets are open at the top and side opposite the vertical wall 30. Central divider 24 is symmetrical with respect to vertical wall 30.

Each of the central dividers 24 extends from the top to the bottom of the display panel, as best seen in FIG. 1. Also, as is evident in FIG. 1, the central dividers 24 can be moved laterally closer together or farther apart in order to accommodate greeting cards of different widths in a very convenient manner. As shown in FIG. 1, adjacent central dividers 24 may be farther apart, as at A to accommodate wide greeting cards, or slightly closer together, as in B, to accommodate narrower greeting cards, or may be in touching engagement along the respective side edges as in C, to accommodate greeting cards of minimum width.

Each of the bottom members 34 and back member 32 immediately thereabove may be formed from a single sheet. Similarly, front member 36, the lowermost bottom member 34, and the lowermost back member 32 may be formed from a single sheet. Each of the bottom members 34 may be welded to the back member 32 in front thereof along the front edge of the bottom member 34. Alternatively, the divider 24 could be integrally molded from a plastic material.

Figure 2:
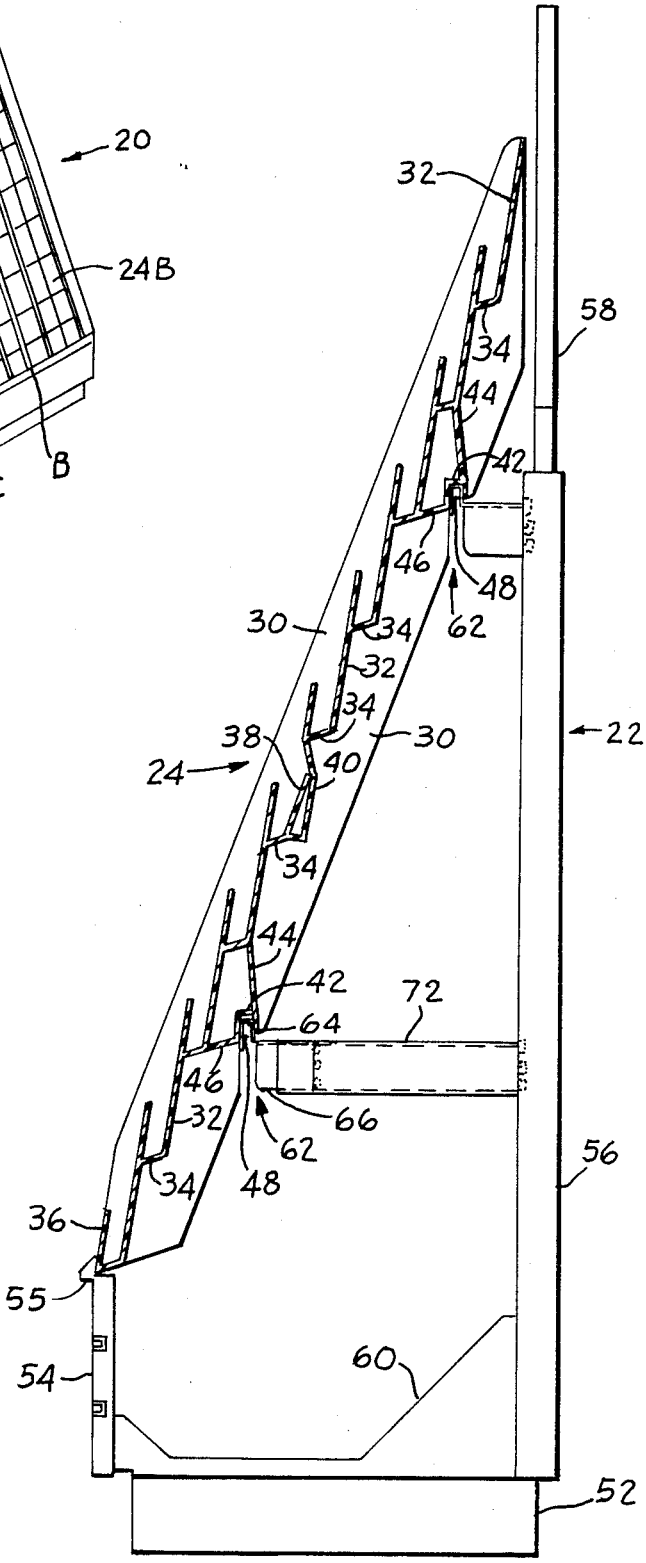
FIG. 2 is a side elevation, with parts in section of the display assembly shown in FIG. 1.

In dividers 24 of appreciable height, as shown in FIG. 2, it may be desirable to vary pocket structure slightly. Thus, near the middle of this divider 24 as shown, a half pocket or compartment formed by the bottom sheet 34, and upstanding back member 38, which is not as high as the back member 32, and a further sheet 40 behind sheet 38 and welded at both its bottom and top edges to bottom members 34.

Beneath the pocket forming structure and therefore, not visible to the customer, are means for receiving a support rail which forms part of the supporting structure 22. These means comprise a pair of spaced three sided sockets 42 of rectangular configuration, joined to the pocket forming structure by means of vertical (or substantially vertical) sheets 44 and gently sloping or horizontal sheets 46. The sheet forming vertical wall 30 is cut away at the sockets 42 to provide access for the supporting rail.

The structure of each of the pocket forming end members or end dividers 24A, 24B is the same as that of a central divider 24, except that all parts heretofore described, including back members 32 and bottom members 34 as well as support pocket forming members 40, extend in one direction only from the vertical plate 30.

Each of the dividers 24, 24A and 24B includes a small vertical web 48, which is parallel with the plane of the vertical wall 30 and which is adapted to be received in a slot in the support rail of the supporting structure 22, as will be hereinafter described.

Figure 9:
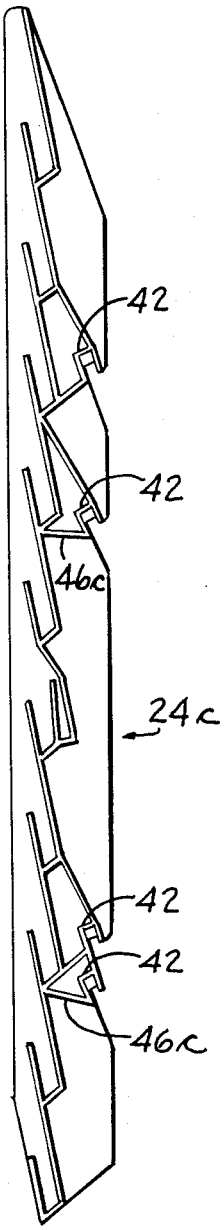
FIG. 9 is a side elevation of a modified form of central divider according to this invention.
Figure 11:
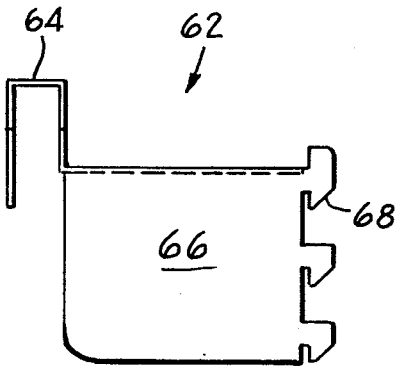
FIGS. 10 and 11 are a front elevation and a side elevation, respectively, of a support rail assembly according to this invention.
Figure 10:
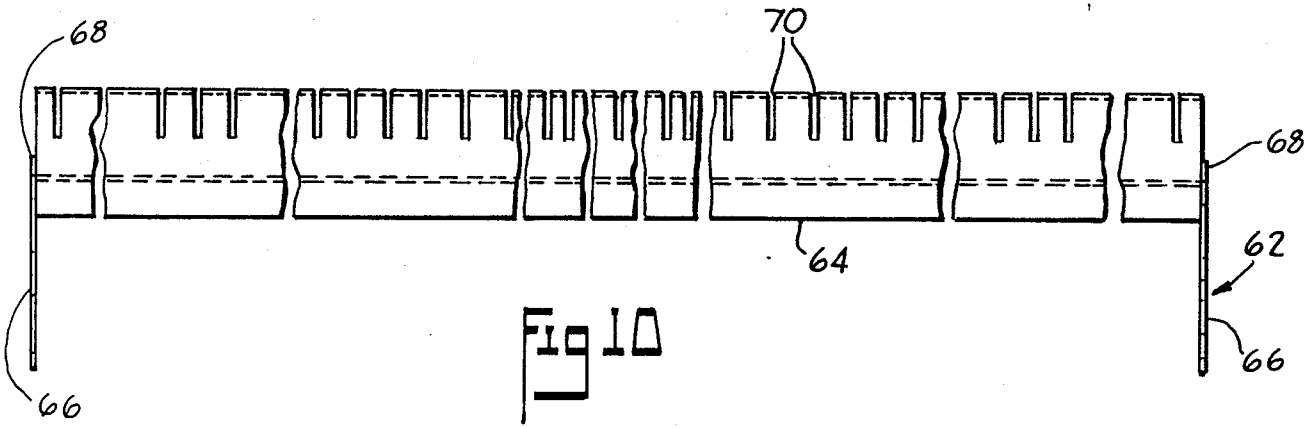

A modified form 24C of central divider is shown in FIG. 9. This modified form is like the form heretofore described except that there are four sockets 42 instead of two for receiving support rails, and the angle of sheets 46 is slightly different from the angle of the corresponding sheet 46 in the first embodiment. This embodiment is particularly desirable when the goods to be displayed are unusually heavy. Normally, however, greeting cards, pamphlets, etc. displayed in devices of this invention, are very light in weight so that this additional support is not needed.

Supporting structure or frame 22 will now be described with particular reference to FIG. 2. Frame 22 comprises a rectangular base 52, which rests on a floor or the ground; a pair of vertical front posts 54 which extend upwardly from the base 52 to the lowest edges of the dividers 24, 24A and 24B, and which is provided with a hook arrangement 55 to receive this lowest edge; a pair of L-shaped slotted back posts 56 which extend upwardly from the two back corners of base 52; a pair of back post extensions 58 which are respectively aligned with and extend upwardly from posts 56; and a pair of flanged side plates 60, which have flanges along the bottom, front and back edges of the main portion shown in FIG. 2. These flanges have bolt holes which are aligned with bolt holes (either round or slotted) in space 52 and posts 54-56 so that base 52 and posts 54, 56 may be bolted together to form a unitary assembly.

Figure 13:
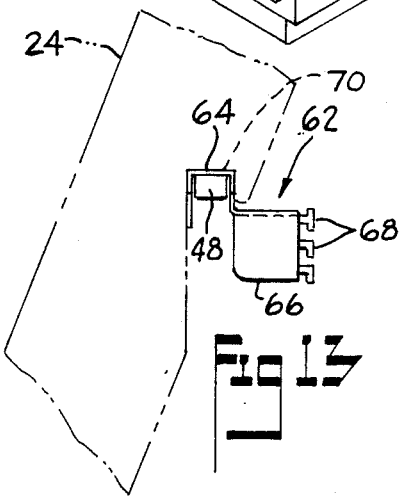
FIG. 13 is a side elevation of a support rail and divider according to this invention, the latter being shown in phantom.
Figure 14:
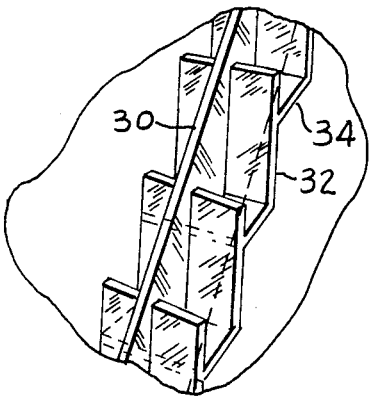
FIG. 14 is a perspective view of a portion of a central divider according to this invention.

Supporting structure 22 also has means 62 for supporting dividers 24, 24A and 24B. These means 62 comprise a sheet having one portion which is formed into a square corner inverted capital U to form support rails 64, and a pair of short arms 66 which extend backwardly therefrom (i.e. toward back posts 56). The back ends of short arms 66 have a plurality of tabs, 68 which are adapted to be received in the slots (best seen in FIG. 1) in posts 56. These slots may be set at a uniform distance apart and comparatively close together so that the support means 62 may be positioned at desired height. This positioning will determine the height above the floor of pocket forming members 24. As may be seen particularly in FIGS. 2 and 13, the configuration of support rail 64 and that of sockets 42 in divider 24 are similar so that each of the dividers 24, 24A and 24B may be positioned at desired locations along support rail 64. Support rails 64 each have a plurality of slots 70, which may be either evenly or unevenly spaced, to receive the web 48 of the dividers 24, 24A and 24B. It is apparent that these dividers may be placed where desired, by placing the web 48 of the divider into slot 70 of which is closest to the desired location.

Figure 12:
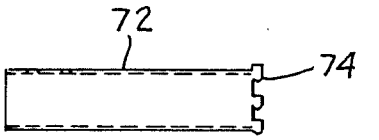
FIG. 12 is a side elevation of an arm extension for supporting a support rail of this invention.

The tab 68 of the upper support member 62 may be inserted directly into slots in posts 56. However, a pair of horizontal arm extensions 72 are required at the lower portion of supporting structure 22 since the lower supporting structure 62 is too remote from back posts 56 for direct insertion. Arm extensions 72 are of sheath-like construction with a narrow rectangular central opening which has about the same dimensions as those of arms 66, being just enough longer and wider to afford sufficient clearance for insertion and removal of arms 66. Thus, arms 66 of the lower supporting structure 62 are inserted into the central opening of arm extensions 72, and arm extensions 72 in turn have tabs 74 (shown in FIG. 12) which are similar to the tabs 68 associated with arms 66.

All or most of the weight of dividers 24, 24A and 24B is borne by the upper support means 62. Lower support means 62 and the hook 55 of front posts 54 serve principally to seat the dividers 24, 24A and 24B firmly so that they will not rotate about the upper support rail 64 as an axis. Each of the central dividers 24 forms two series of half pockets in step arrangement (one series on each side of vertical plate 30), while each of the end dividers 24A and 24B forms a single series of half pockets. Each pair of adjacent dividers 24, 24A and 24B together form whole pockets or compartments.

The display assembly 20 of this invention is easily assembled and disassembled, is portable, and is readily adjustable, by moving adjacent dividers 24 either towards or away from each other in order to accommodate cards or pamphlets of different widths. It is aesthetically pleasing, since the gaps A and B between adjacent dividers 24 (when they are not set with their edges touching as at C) is so small that the customer does not notice the supporting structure 22 which lies behind the display panel, especially when the display assembly or rack 20 is substantially filled.

While in accordance with the patent statutes only the best mode and preferred embodiment of the invention has been illustrated and described in detail, it is to be understood that the invention is not limited thereto or thereby, but that the scope of the invention is defined by the appended claims.

What is claimed is:

1. An adjustable display assembly comprising:

a supporting structure including at least two transversely extending support rails having an inverted U-shaped portion, and a plurality of pocket forming members adjustably positioned on and supported by said supporting structure in side by side relationship, said pocket forming members comprising:

(1) at least one laterally movable pocket forming member located between the lateral edges of said supporting structure, said laterally movable pocket forming member comprising a generally vertical wall and a pocket forming structure extending laterally on both sides of said vertical wall, said pocket forming structure comprising a plurality of generally upright parallel back members and a plurality of bottom members arranged in step relationship and forming a plurality of half pockets in step relationship on either side of said vertical wall, the sides of said half pockets which are remote from said vertical wall being open, and an upstanding front member extending upwardly from the front edge of the respective of each bottom member generally parallel to said back members but of lesser height; and (2) right hand and left hand end pocket forming members disposed along the right and left sides, respectively, of said supporting structure, said right hand and said left hand end pocket forming members being of similar construction but oppositely oriented, each of said right hand and left hand end pocket forming members comprising a generally vertical wall along one edge thereof, and a pocket forming structure forming a plurality of half pockets in generally step relationship, the last mentioned pocket forming structure comprising a plurality of generally upright substantially parallel back members and a plurality of bottom members extending laterally in one direction only from the last mentioned vertical wall, the sides of the last mentioned half pockets which are remote from said last mentioned vertical wall being open, and said last mentioned pocket forming structure also comprising an upstanding front member extending upwardly from the front edge of the respective of each last mentioned bottom member generally parallel to the last mentioned back members but of lesser height, said last mentioned back members and said last mentioned bottom members and the last mentioned front members extending inwardly from said last mentioned vertical wall toward said at least one laterally movable pocket forming member, wherein each of said end pocket forming members and said at least one laterally movable pocket forming member includes at least two socket means forming inverted U-shaped sockets which receivingly engage said inverted U-shaped portion on said support rails to support said plurality of pocket forming members at intermediate locations thereon and together with another of said pocket forming members, form a plurality of pockets having the pocket size thereof adjustable by means of said laterally movable pocket forming member.

2. A display assembly according to claim 1 in which a plurality of spaced generally vertical slots are formed in each of said support rails with each of said pocket forming members having a vertical web formed in said socket means adapted to be removably received in coacting relation in a selected one of said slots.

3. A display assembly according to claim 1 wherein said vertical wall of each end pocket forming member intersects the laterally extending members of said end pocket forming member along aligned corresponding edges of said laterally extending members.

4. An adjustable display assembly comprising:

a supporting structure, and a plurality of pocket forming members adjustably positioned on and supported by said supporting structure in side by side relationship, said pocket forming members comprising:

(1) at least one laterally movable pocket forming member located between the lateral edges of said supporting structure, said laterally movable pocket forming member comprising a generally vertical wall and a pocket forming structure extending laterally on both sides of said vertical wall, said pocket forming structure comprising a plurality of generally upright parallel back members and a plurality of bottom members arranged in step relationship and forming a plurality of half pockets in step relationship on either side of said vertical wall, the sides of said half pockets which are remote from said vertical wall being open, and an upstanding front member extending upwardly from the front edge of the respective of each bottom member generally parallel to said back members but of lesser height;

(2) right hand and left hand end pocket forming members disposed along the right and left sides, respectively, of said supporting structure, said right hand and said left hand end pocket forming members being of similar construction but oppositely oriented, each of said right hand and left hand end pocket forming members comprising a generally vertical wall along one edge thereof, and a pocket forming structure forming a plurality of half pockets in generally step relationship, the last mentioned pocket forming structure comprising a plurality of generally upright substantially parallel back members and a plurality of bottom members extending laterally in one direction only from the last mentioned vertical wall, the sides of the last mentioned half pockets which are remote from said last mentioned vertical wall being open, and said last mentioned pocket forming structure also comprising an upstanding front member extending upwardly from the front edge of the respective of each last mentioned bottom member generally parallel to the last mentioned back members but of lesser height, said last mentioned back members and said last mentioned bottom members and the last mentioned front members extending inwardly from said last mentioned vertical wall toward said at least one laterally movable pocket forming member, wherein each of said end pocket forming members and said laterally movable pocket forming member together with a pocket forming member, form a plurality of pockets having the pocket size thereof adjustable by means of said laterally movable pocket forming member;

(3) said support structure including at least two transversely extending support rails supporting said plurality of pocket forming members at intermediate locations thereof; and (4) means on said support rail coacting with socket means formed on said pocket forming members for adjustably positioning and supporting said pocket forming members on said support structure, said means on said support rail comprising a plurality of laterally spaced generally vertically oriented slots therein and said socket means having a generally vertical web projecting in a downward direction therefrom and received in coacting relation in a selected one of said slots in the respective of said support rails.

5. A display assembly in accordance with claim 4 wherein said support rails are positioned intermediate the front and the back of said supporting structure, with each said pocket forming member including a pair of said webs, with each of the latter being received in a respective slot in a respective one of said support rails.

6. A display assembly in accordance with claims 4 wherein said web on said at least one laterally movable pocket forming member being disposed in a generally vertical plane extending substantially parallel with the vertical center plane of the first mentioned vertical wall.

7. A display assembly in accordance with claim 4 wherein said web on each of said end pocket forming members is disposed in a generally vertical plane offset laterally from the vertical center plane of said last mentioned vertical wall.

* * * * *